US009788101B2

(12) United States Patent
Chizi et al.

(10) Patent No.: US 9,788,101 B2
(45) Date of Patent: Oct. 10, 2017

(54) METHOD FOR INCREASING THE AWARENESS OF HEADPHONE USERS, USING SELECTIVE AUDIO

(71) Applicant: DEUTSCHE TELEKOM AG, Bonn (DE)

(72) Inventors: Barak Chizi, Ashkelon (IL); David (Dudu) Mimran, Tel Aviv (IL); Bracha Shapira, Beer Sheva (IL); Gil Rosen, Tel-Mond (IL)

(73) Assignee: DEUTSCHE TELEKOM AG, Bonn (DE)

( * ) Notice: Subject to any disclaimer, the term of this patent is extended or adjusted under 35 U.S.C. 154(b) by 0 days.

(21) Appl. No.: 14/791,927

(22) Filed: Jul. 6, 2015

(65) Prior Publication Data

US 2016/0014497 A1 Jan. 14, 2016

(30) Foreign Application Priority Data

Jul. 10, 2014 (IL) ..... 233616

(51) Int. Cl.
*H04R 1/10* (2006.01)
*G08B 3/10* (2006.01)
(Continued)

(52) U.S. Cl.
CPC ..... *H04R 1/1091* (2013.01); *G08B 3/10* (2013.01); *G08B 21/02* (2013.01); *G10K 11/175* (2013.01);
(Continued)

(58) Field of Classification Search
CPC .. H04R 1/1091; H04R 1/1041; H04R 1/1083; G08B 3/10; G08B 21/02; G10K 11/175; G10K 2210/1081
See application file for complete search history.

(56) References Cited

U.S. PATENT DOCUMENTS 7,903,825 B1 3/2011 Melanson
8,804,974 B1 * 8/2014 Melanson ..... H03G 3/32 381/57
(Continued)

FOREIGN PATENT DOCUMENTS

EP 2430753 B1 10/2012
WO 2007007916 A1 1/2007

OTHER PUBLICATIONS

Communication and European Search Report from a counterpart foreign application—EP15176299—7 pages, dated May 3, 2016.

*Primary Examiner* — Andrew L Sniezek
(74) *Attorney, Agent, or Firm* — Roach Brown McCarthy & Gruber, P.C.; Kevin D. McCarthy

(57) ABSTRACT

A method for providing elected sounds to a user—isolated from sounds of the environment—of a mobile device to increase his awareness regarding entities or events in his vicinity. The user wears sound isolating headphones connected to his mobile device. A mobile application is installed on the mobile device, and is automatically activated when the headphones are connected to his mobile device. The application is adapted to automatically activate the device's microphone when the isolating headphones are plugged into the device and periodically compare in real-time, sounds received from the environment, to a predefined collection of reference sounds. Sounds of the environment, which match one or more reference sounds from the collection are selectively filtered out and as long as the sounds received from the environment match the one or more reference sounds from the collection, the filtered sounds are continuously passed to the isolating headphones.

14 Claims, 5 Drawing Sheets

(51) Int. Cl.
*G08B 21/02* (2006.01)
*G10K 11/175* (2006.01)

(52) U.S. Cl.
CPC .... *G10K 2210/1081* (2013.01); *H04R 1/1041* (2013.01); *H04R 1/1083* (2013.01)

(56) References Cited

U.S. PATENT DOCUMENTS

| | | | | |
|---|---|---|---|---|
| 9,197,177 | B2 * | 11/2015 | Zong | H04R 3/005 |
| 9,357,320 | B2 * | 5/2016 | Gelter | H04R 29/00 |
| 9,509,269 | B1 * | 11/2016 | Rosenberg | G11B 27/105 |
| 9,513,157 | B2 * | 12/2016 | Cohen | H04S 1/00 |
| 2001/0046304 | A1 | 11/2001 | Rast | |
| 2007/0189544 | A1 * | 8/2007 | Rosenberg | H03G 3/32 381/57 |
| 2009/0232325 | A1 | 9/2009 | Lundquist | |
| 2014/0044269 | A1 | 2/2014 | Anderson | |

* cited by examiner

METHOD FOR INCREASING THE AWARENESS OF HEADPHONE USERS, USING SELECTIVE AUDIO

FIELD OF THE INVENTION

The present invention relates to the field of monitoring systems. More particularly, the invention relates to a system and method for providing selective alerts in the form of sounds to users of isolating headphones, via their mobile devices.

BACKGROUND OF THE INVENTION

Many users of mobile phones (or other mobile devices with a connection to cellular networks) use them for listening to content, such as music in the form of audio files stored on the mobile phone, or listening to streamed audio broadcasted from radio stations via the cellular network. In order to isolate environmental noises, most of the users use large headphones, which cover the entire auricle of each ear. This may cause safety problems, since the user cannot hear sounds that should increase his level of caution, such as approaching vehicles (if he walks on the sidewalk) or an approaching dog which may attack him while jogging in a park.

Some of the existing headphones have a built in microphone, which can be activated when the user wishes to be exposed to environmental noise by simultaneously disabling the audio channel of the cellphone. However, this requires the user's intension and active operation, which are not always possible while he is walking or jogging.

In addition, while being audibly isolated from the environment, the user sometimes interacts with his mobile device. This interaction decreases his awareness to the environment even more.

It is therefore desired to provide a sound alert to the user, that increases his awareness regarding risks or entities of interest in his vicinity.

It is an object of the present invention to provide a method and system for providing sound alerts to a user that increase his awareness regarding risks or in his vicinity.

It is another additional object of the present invention to provide a method and system for providing selectively filtering sounds of the environment, which are relevant to his location and context.

Other objects and advantages of the invention will become apparent as the description proceeds.

SUMMARY OF THE INVENTION

The present invention is directed to a method for providing elected sounds to a user of a mobile device, who is isolated from sounds of the environment, to increase his awareness regarding entities or events in his vicinity. The user wears sound isolating headphones, which are connected to his mobile device and isolate him from sounds of the environment. A mobile application is installed on the mobile device, and is automatically activated when the headphones are connected to his mobile device. The mobile application is adapted to automatically activate the microphone of the mobile device, when the isolating headphones are plugged into the mobile device and periodically compare in real-time, sounds received from the environment, to a predefined collection of reference sounds. Sounds of the environment, which match one or more reference sounds from the collection are selectively filtered out and as long as the sounds received from the environment match the one or more reference sounds from the collection, the filtered sounds are continuously passed to the isolating headphones.

The collection of reference sounds may be generated by the user or by an administrator and stored offline locally on in a database.

The sounds received from the environment may be associated with surrounding threats, to which the user who wears the isolating headphones is exposed when being outdoors. The surrounding threats may be:

- dynamic moving entities along the user's movement path;
- static stationary entities along the user's movement path;
- happening events, which take place in real-time along the user's movement path; and
- caused events, which take place in real-time along the user's movement path, due to the movement.

The mobile application may also include predetermined filters that select only sounds that match predefined criteria, such that only sounds that are highly correlated with patterns of the reference sounds will be passed to the user's headphones.

The mobile application may include one or more of the following modules:

- a Context Based Filtering Module;
- a Location Based Filtering Module;
- a Friends Notification Module.

The mobile application may be adapted to increase or decrease the volume of the sounds that will be selected by a filter, according to the distance of the user from the environmental sounds source.

The present invention is also directed to a system for providing elected sounds to a user of a mobile device, who is isolated from sounds of the environment, to increase his awareness regarding entities or events in his vicinity, the system comprises:

a) a plurality of mobile devices of users, each of which are being connected to sound isolating headphones adapted to be worn;

b) a mobile application installed on the mobile devices, the mobile application is adapted to:

- b.1) automatically activate the microphone of the mobile device, when the isolating headphones are plugged into the mobile device;
- b.2) periodically compare in real-time, sounds received from the environment, to a predefined collection of reference sounds;
- b.3) selectively filter sounds out of the environment, which match one or more reference sounds from the collection; and
- b.4) as long as the sounds received from the environment match the one or more reference sounds from the collection, continuously pass the filtered sounds, to the isolating headphones.

DETAILED DESCRIPTION OF PREFERRED EMBODIMENTS

The system and method of the present invention are capable of providing sound alerts to a user, in order increase his awareness regarding risks or entities of interest in his vicinity, of which he is unaware. The suggested platform filters out the important audio hazards while enabling the user enjoying the audio experience with his headphones. The system uses a filtering mechanism that can be tuned to provide different filtering profiles to different scenarios (e.g., avoiding a dog running after the user while jogging with headphones).

Figure 1:
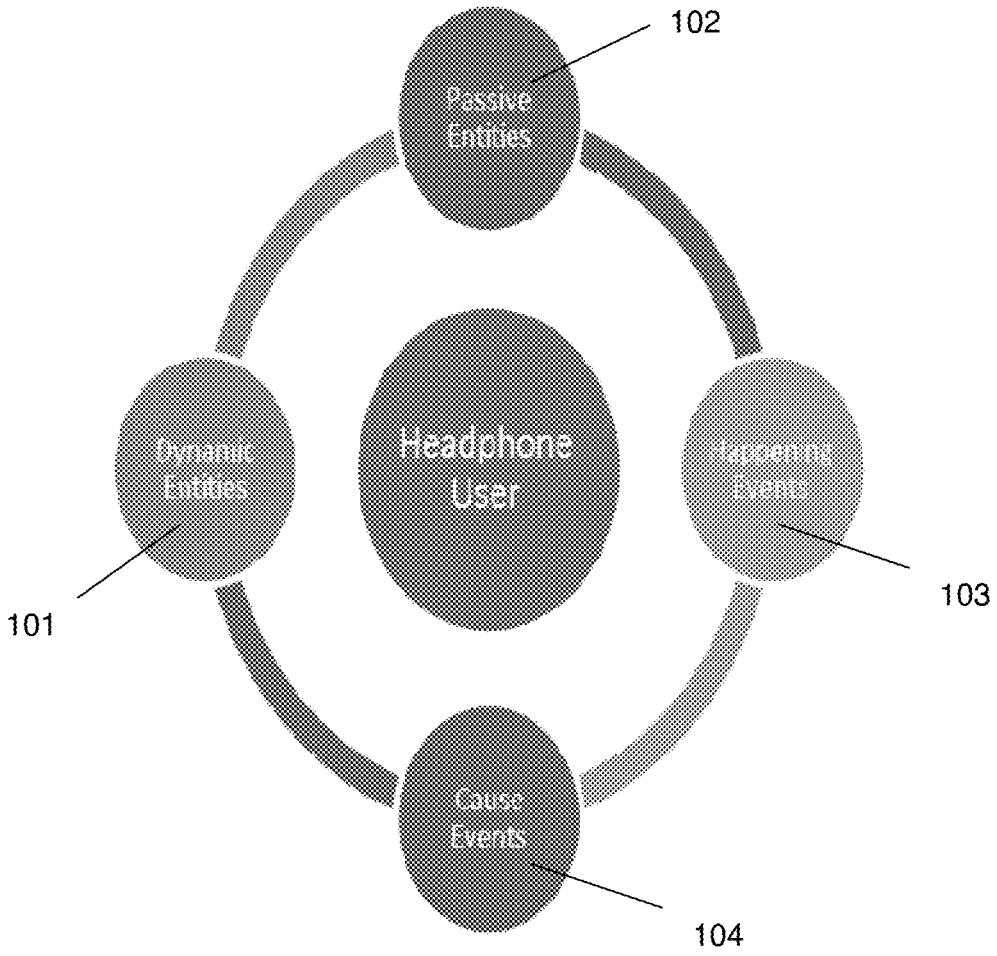
FIG. 1 schematically illustrates some examples of surrounding threats, to which a user who wares isolating headphones is exposed when being outdoors.

FIG. 1 schematically illustrates some examples of surrounding threats, to which a user who wares isolating headphones is exposed when being outdoors. On his way, the user may encounter dynamic (moving) entities, such as moving objects along his path, people in move or animals that pass nearby the path. Any such moving entity may become a potential obstacle, into which the user may crash or by which he may be hurt, due to isolation from environmental sounds and his unawareness of moving (dynamic) entities.

The user may also encounter passive entities 102 which are not moving, such as static objects, standing people or animals that are located along his path. Any such static entity may also become a potential obstacle, into which the user may crash, due to isolation from environmental sounds and his unawareness.

Another type of potential obstacles is happening events 103, which take place in real-time along the user's movement path. For example, these obstacles may be places, which become crowded due to an accident, fire, demonstration or to criminal events, which happen without any connection to the user. An alert that is passed to the user may cause him to change his path, in order to avoid such encounters.

Another type of potential incidents is caused events 104, which take place in real-time along the user's movement path because of him. Such incidents may be events that are initiated by the movement of the user along his path. For example, a user who is running in a park may avoid an event of being bitten by a running dog, if he gets an alert that may cause him to change his path, in order to not to initiate such event.

Figure 2:
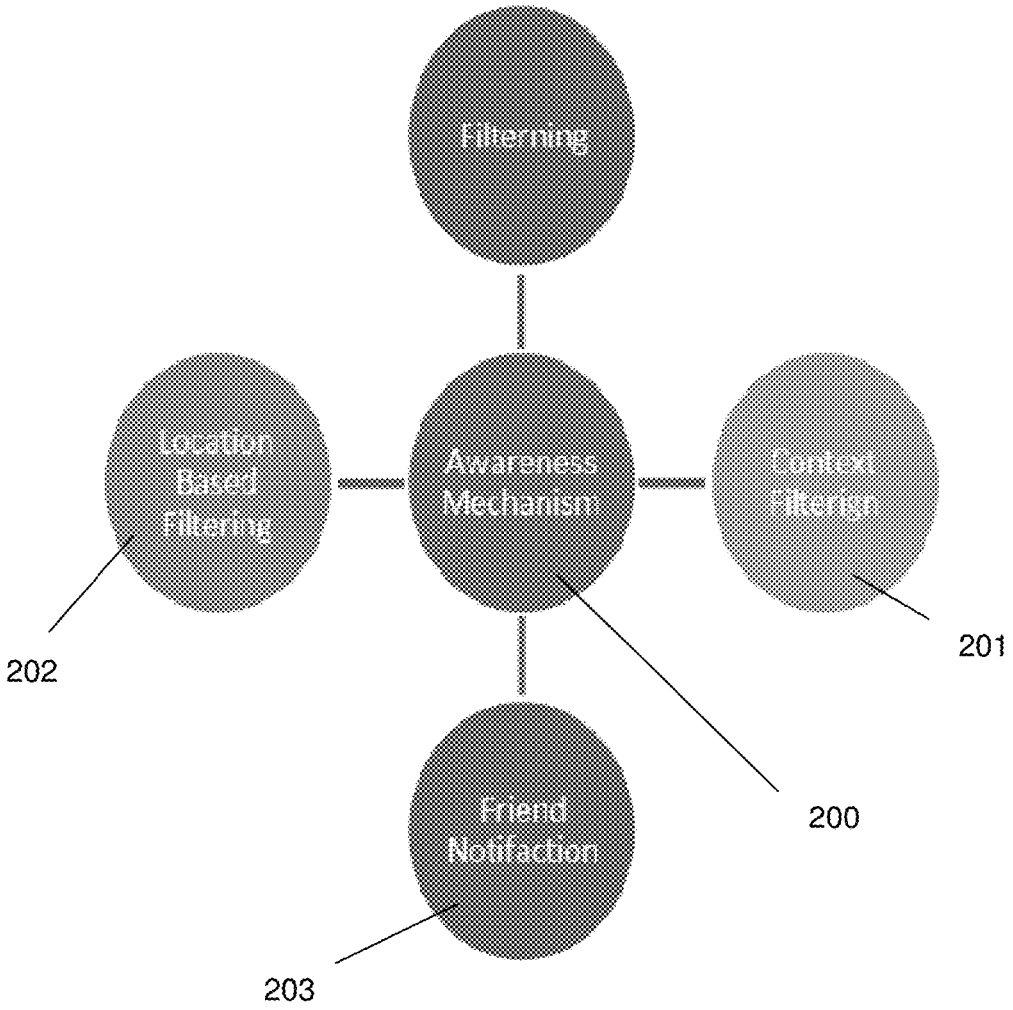
FIG. 2 schematically illustrates the architecture of an awareness mechanism for providing appropriate alerts, according to an embodiment of the invention.

FIG. 2 schematically illustrates the architecture of an awareness mechanism for providing appropriate alerts, according to an embodiment of the invention. The proposed awareness mechanism 200 is based on selectively filtering sounds of the environment, which are received in real-time by the microphone of the user's mobile device. The received sounds are compared in real-time to a predefined collection of reference sounds, which may be stored offline locally on in a database. For example, such a collection may be generated by recording a characteristic sound for each potential scenario or threat, such as typical voice patterns or voice signatures of a barking dog, a moving vehicle, a moving train, a horning vehicle, crowd, siren of an ambulance or of other rescue vehicle, etc. This reference collection can be created by the user or by an administrator.

The awareness mechanism 200 may be implemented by an application that will be installed on each mobile device. When activated, the application will automatically turn on the inherent microphone of the user's mobile device, and will start receiving sounds from the environment in real-time. The application will have predetermined filters which will select only sounds that match predefined criteria, such as typical patterns that will be pre-recorded. Only sounds that will be highly correlated with the patterns will be passed to the user's headphones, so the user will be able to hear them. All other sounds will be blocked by the application. The application will be able to identify and classify the received sounds, in order to compare them to the relevant patterns.

The application may include the following modules:

Context Based Filtering Module

The Context Based Filtering Module 201 allows the user to select and hear sounds which are filtered from the sounds of his surrounding environment, according to his current context. Instead of filtering static sounds, the user will be able to filter only sounds that comply with his current context. For example, sounds of a barking dog are relevant for a user that is jogging in a park, but are not relevant to a user who is currently traveling on a bus or on a train.

Location Based Filtering Module

The Location Based Filtering Module 202 allows the user to filter sounds from the environment, only when he enters a specific location or to a predefined set of locations. This can be done with every component described above. For example, if the microphone of the mobile device receives sounds of a barking dog which is inside a yard of a house, the application will block this sound and the user will not hear it, since a dog in a yard is not a potential threat. However, if the microphone of the mobile device receives sounds of a barking dog which is on the street, the application will filter this sound from the environment and the user will hear it, since a free dog is a potential threat.

Friends Notification Module

The Friends Notification Module 203 allows the user to filter from the environment, sounds that are originated from friends of the user. This will allow the user to be aware only of the sounds that might be interesting to him and to ignore other sounds. These sounds can be voices of his friends, their sound signatures or other sounds they produce (e.g., coughing). For example, the user can receive a sound from a common friend regarding another friend that is nearby, which (according to the common friend) may be of interest to him. This is a type of filtering that is based on knowing the preferences of each user, such that filtering is tuned by fiends that have knowledge about the user.

The application 43 will also be adapted to increase or decrease the volume (using a volume control module 53) of the sounds that will be selected by a filter, according to the distance of the user from the sounds source. For example, if the user becomes closer to a barking dog, the sound's magnitude will be increased.

Figure 3:
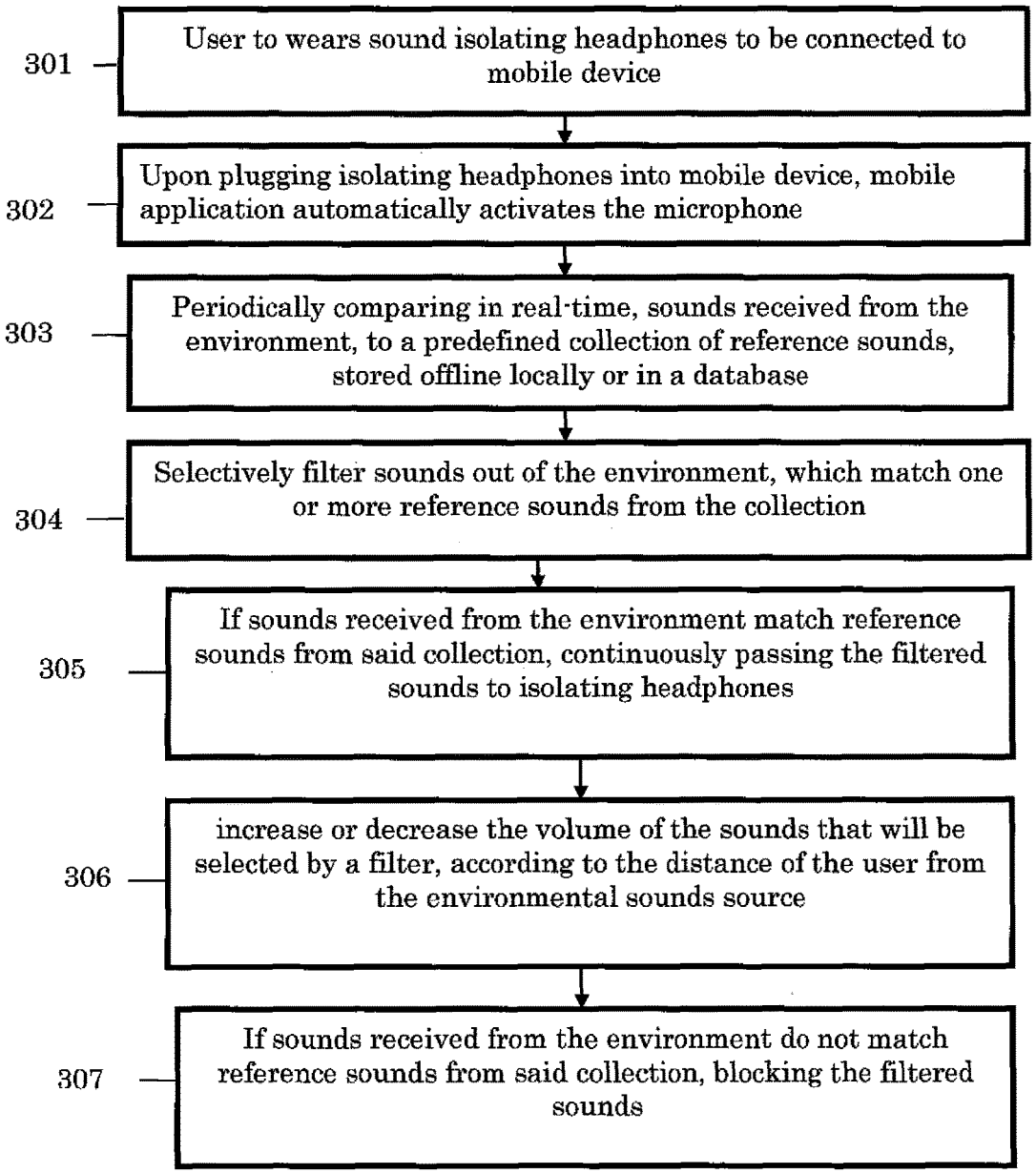
FIG. 3 is a flowchart illustrating the process of providing elected sounds to a user of a mobile device, who is isolated from sounds of the environment, so as to increase his awareness regarding entities or events in his vicinity.

FIG. 3 is a flowchart illustrating the process of providing elected sounds to a user of a mobile device, who is isolated from sounds of the environment, so as to increase his awareness regarding entities or events in his vicinity. At the first step 301, the user wears sound isolating headphones to be connected to mobile device. At the next step 302, upon plugging the isolating headphones into mobile device, the mobile application automatically activates the microphone. At the next step 303, sounds received from the environment, are periodically compared in real-time to a predefined collection of reference sounds, stored offline locally, or in a database. At the next step 304, sounds out of the environment, which match one or more reference sounds from the collection, are selectively filtered. At the next step 305, if sounds received from the environment match reference sounds from said collection, the filtered sounds are continuously passed to the isolating headphones. At the next step 306, the volume of the sounds that will be selected by a filter is increased or decreased, according to the distance of the user from the environmental sounds source. At the next step 307, if sounds received from the environment do not match reference sounds from the collection, the filtered sounds are blocked.

Figure 4:
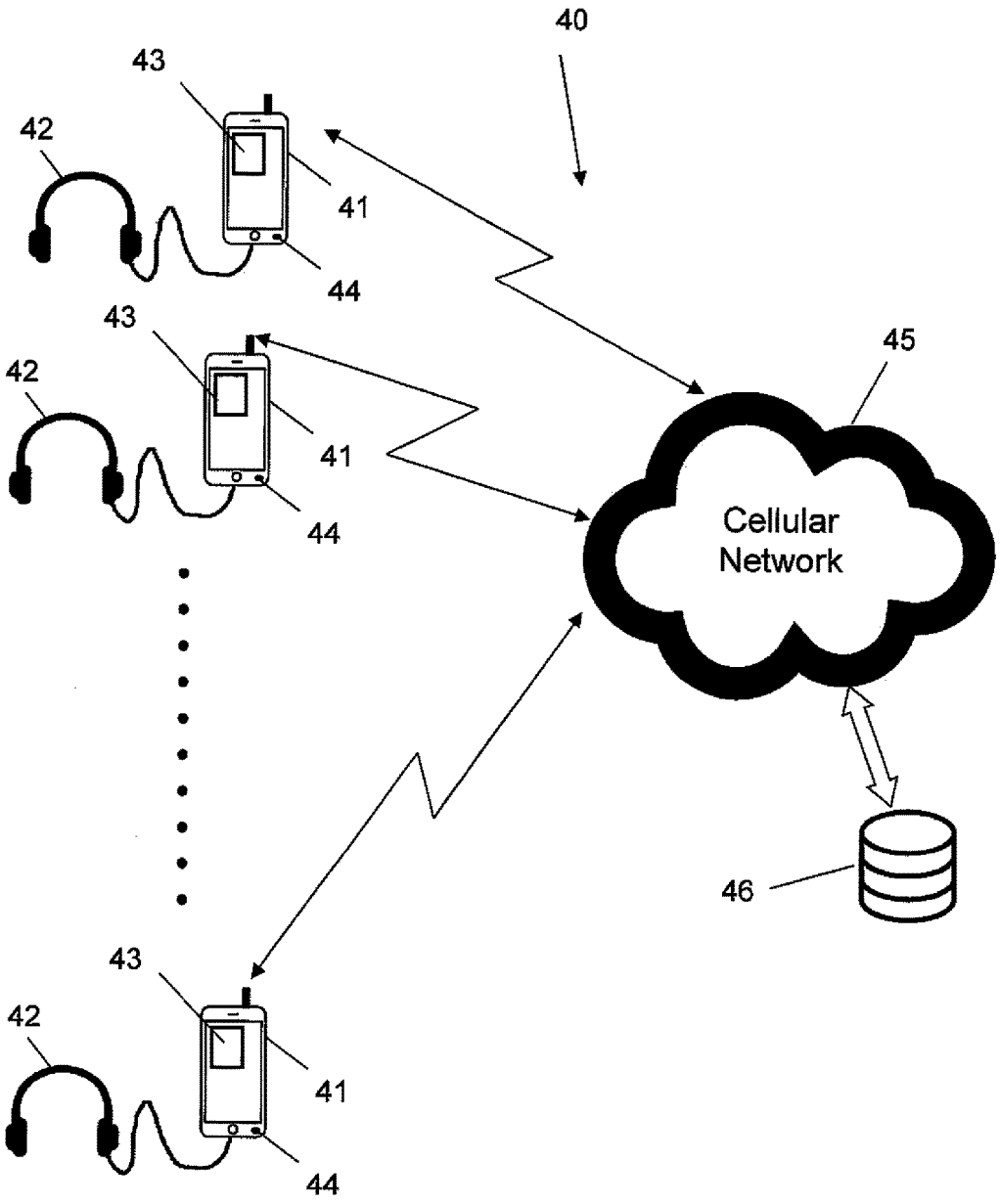
FIG. 4 illustrates a system for providing elected sounds to a user of a mobile device, who is isolated from sounds of the environment.

FIG. 4 illustrates a system for providing elected sounds to a user of a mobile device (connected to a cellular network 45), who is isolated from sounds of the environment, to increase his awareness regarding entities or events in his vicinity, according to an embodiment of the invention. The system 40 comprises a plurality of mobile devices of users 41, each mobile device is connected to sound isolating headphones 42 that are adapted to be worn. Each mobile device has an application 43 stored therein that is adapted to automatically activate its microphone 44 when the isolating headphones are plugged into the mobile devices. The application periodically compares in real-time, sounds received from the environment, with a collection of reference sounds that may be stored in a database 46, accessible by cellular network 45 via a server (not shown) and selectively filter sounds out of the environment, which matches reference sounds from this collection. As long as the sounds received from the environment match one (or more) reference sounds from the collection, the application 43 continuously passes the filtered sounds, to the isolating headphones 42.

Figure 5:
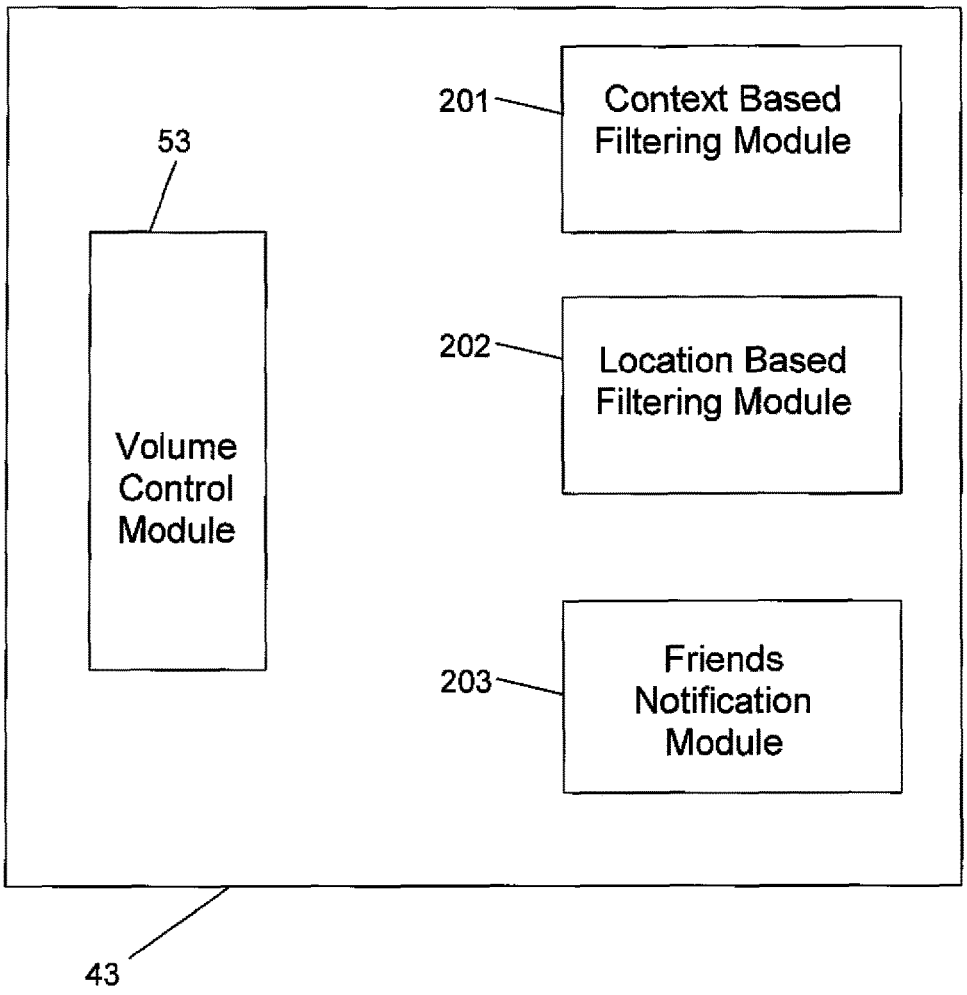
FIG. 5 is a block diagram of the modules of the application installed on each mobile device.

FIG. 5 is a block diagram of the modules of the application 43. The application 43 comprises a Context Based Filtering Module 201 that allows the user to select and hear sounds which are filtered from the sounds of his surrounding environment, according to his current context; a Location Based Filtering Module 202 that allows the user to filter sounds from the environment, only when he enters a specific location or to a predefined set of locations; a Friends Notification Module 203 that allows the user to filter from the environment, sounds that are originated from friends of the user; a Volume Control Module 53, adapted to increase or decrease the volume of the sounds that will be selected by a filter, according to the distance of the user from the sounds source.

While some embodiments of the invention have been described by way of illustration, it will be apparent that the invention can be carried out with many modifications, variations and adaptations, and with the use of numerous equivalents or alternative solutions that are within the scope of persons skilled in the art, without exceeding the scope of the claims.

The invention claimed is:

1. A method for providing elected sounds to a user of a cellular mobile device, who is isolated from sounds of the environment, to increase his awareness regarding entities or events in his vicinity, comprising the steps of:

a) remotely storing a predefined collection of reference sounds in a database;

b) by said user, wearing sound isolating headphones, which are connected to his mobile device;

c) installing a mobile application on said mobile device, said mobile application is configured to:

c.1) automatically activate a microphone of said mobile device, when the isolating headphones are plugged into said mobile device;

c.2) periodically compare in real-time, sounds received from the environment via said microphone, to said collection of reference sounds;

c.3) selectively filter sounds out of the environment, which match one or more reference sounds from said collection; and c.4) as long as the sounds received from the environment match said one or more reference sounds from said collection, continuously pass the filtered sounds to said isolating headphones, wherein the filtered sounds that are passed to said isolating headphones are filtered according to a current context and location associated with surrounding threats to which the user wearing said isolating headphones is exposed when being outdoors and constitute sound alerts, wherein a cellular based sound alert is passed to the user to indicate that a movement path of the user should be changed in order to avoid an encounter with an obstacle.

2. The method according to claim 1, wherein the collection of reference sounds are generated by the user or by an administrator.

3. The method according to claim 1, wherein the surrounding threats are selected from the group of:

dynamic moving entities along the user's movement path;

static stationary entities along the user's movement path;

happening events, which take place in real-time along the user's movement path; and caused events, which take place in real-time along the user's movement path, due to said movement.

4. The method according to claim 1, wherein the mobile application includes predetermined filters that select only sounds that match predefined criteria, such that only sounds that are highly correlated with patterns of the reference sounds will be passed to the user's headphones.

5. The method according to claim 1, wherein the mobile application includes one or more of the following modules:

a Context Based Filtering Module;

a Location Based Filtering Module;

a Friends Notification Module; and a Volume Control Module.

6. The method according to claim 1, wherein the mobile application is also configured to increase or decrease a volume of the sounds that will be selected by a filter, according to a distance of the user from an environmental sound source.

7. The method according to claim 1, wherein the obstacle is a place that has become crowded.

8. The method according to claim 7, wherein the place has become crowded due to an accident, fire, demonstration or criminal event.

9. The method according to claim 1, wherein the obstacle is caused by movement of the user along his path.

10. A system for providing elected sounds to a user of a cellular mobile device, who is isolated from sounds of the environment, to increase his awareness regarding entities or events in his vicinity, comprising:

a) a cellular mobile device;

b) wearable sound isolating headphones connected to said mobile device;

c) a remote database in which a predefined collection of reference sounds is stored;

d) a mobile application installed on said mobile device, said mobile application configured to perform the following actions:

d.1) automatically activate a microphone of said cellular mobile device, when the isolating headphones are plugged into said cellular mobile device;

d.2) periodically compare in real-time, sounds received from the environment via said microphone, to said collection of reference sounds;

d.3) selectively filter sounds out of the environment, which match one or more reference sounds from said collection; and d.4) as long as the sounds received from the environment match said one or more reference sounds from said collection, continuously pass the filtered sounds to said isolating headphones, wherein the filtered sounds that are passed to said isolating headphones are filtered according to a current context and location associated with surrounding threats to which the user wearing said isolating headphones is exposed when being outdoors and constitute sound alerts, wherein a cellular based sound alert is passed to the user to indicate that a movement path of the user should be changed in order to avoid an encounter with an obstacle.

11. The system according to claim 10, wherein the mobile application includes predetermined filters that select only sounds that match predefined criteria, such that only sounds that are highly correlated with patterns of the reference sounds will be passed to the user's headphones.

12. The system according to claim 10, wherein the mobile application includes one or more of the following modules:

a Context Based Filtering Module;

a Location Based Filtering Module;

a Friends Notification Module; and a Volume Control Module.

13. The system according to claim 10, wherein the mobile application is configured to increase or decrease, by the Volume Control Module, the volume of the sounds that will be selected by a filter, according to a distance of the user from an environmental sound source.

14. The system according to claim 10, comprising a plurality of the cellular mobile devices, to each of which a corresponding pair of the sound isolating headphones is connected and on each of which the mobile application is installed.

* * * * *